US005972550A

United States Patent [19]

Tamura et al.

[11] Patent Number: 5,972,550

[45] Date of Patent: Oct. 26, 1999

[54] ELECTROPHOTOGRAPHIC PHOTOCONDUCTOR AND METHOD OF MANUFACTURING SAME

[75] Inventors: Yukihisa Tamura; Sumitaka Nogami, both of Nagano, Japan

[73] Assignee: Fuji Electric Co., Ltd., Japan

[21] Appl. No.: 08/779,454

[22] Filed: Jan. 7, 1997

[30] Foreign Application Priority Data

| | | | |
|---|---|---|---|
| Jan. 18, 1996 | [JP] | Japan | 8-023416 |
| Aug. 9, 1996 | [JP] | Japan | 8-211026 |

[51] Int. Cl.[6] ..... G03G 5/14

[52] U.S. Cl. ..... 430/65; 430/60; 430/64; 430/131

[58] Field of Search ..... 430/60, 63, 64, 430/65, 131

[56] References Cited

U.S. PATENT DOCUMENTS

| | | | |
|---|---|---|---|
| 4,906,545 | 3/1990 | Fukagai et al. | 430/58 |
| 5,419,993 | 5/1995 | Sakakibara et al. | 430/62 |
| 5,486,440 | 1/1996 | Kashizaki et al. | 430/62 |
| 5,612,158 | 3/1997 | Iguchi et al. | 430/58 |
| 5,744,271 | 4/1998 | Aizawa et al. | 430/63 |

FOREIGN PATENT DOCUMENTS

| | | | |
|---|---|---|---|
| 2-226163 | 9/1990 | Japan | 430/63 |
| 3-209261 | 9/1991 | Japan . | |
| 4-15657 | 1/1992 | Japan | 430/63 |

OTHER PUBLICATIONS

Willard, H.H. et al. *Instrumental Methods of Analysis,* 6th Edition, Van Nostrand Co., NY (1981), pp. 394–403.

Patent & Trademark Office English–Language Translation of JP 2–226163 (Pub Sep. 1990).

Patent & Trademark Office English–Language Translation of JP 3–209261 (Pub. Sep. 1991).

Caplus Abstract AN: 1995: 275444 of JP 06271728 (Pub Sep. 1994).

Derwent Abstract 90–316893/42 of JP 2–226163 (Pub Sep. 1990).

Japio Abstract AN 90–226163 of JP 2–226163 (Pub Sep. 1990).

Paper Chem 2 Abstract AN 92:10304 of JP 4–15657 (Pub Jan. 1992).

Lieng–Huang Lee, ed. "Characterization of Metal & Polymner Surfaces" vol. 1–Metal Surfaces, Academic Press, NY (1977), pp. 399–430.

*Primary Examiner*—Janis L. Dote

*Attorney, Agent, or Firm*—Morrison Law Firm

[57] ABSTRACT

A laminate type organic electrophotographic photoconductor uses a thick undercoating layer as an intermediate layer for reducing the influence of a conductive substrate on a charge generation layer. An organosilicon coupling agent is bonded to the surfaces of small particles of titanium oxide, zirconium oxide, aluminum oxide or cerium oxide, at an Existence Ratio represented by the peak intensity ratio (Si2p/Me2p, Me=Ti, Zr or Al) or (Si2p/Ce3d) of from 0.15 to 0.6 of a bonding energy spectrum measured by X-ray photoelectron spectroscopy. The metal oxide small particles, the surfaces of which have been treated mechanochemically, are cleaned to reduce the ionic impurity concentration of the undercoating layer to below 1 ppm. The cleaned metal oxide small particles are dispersed into the polyamide copolymer binder resin for the undercoating layer. The undercoating layer produced in this manner results in a electrophotographic photoconductor whose electrical properties are constant despite environmental changes and repeated use. The electrophotographic photoconductor also resists residual potential rise after repeated use, and also resists image defect formation despite changes in environmental conditions and operating conditions.

9 Claims, No Drawings

ELECTROPHOTOGRAPHIC PHOTOCONDUCTOR AND METHOD OF MANUFACTURING SAME

BACKGROUND OF THE INVENTION

The present invention relates to a laminate-type electrophotographic photoconductor which has an undercoating layer on an electrically conductive substrate and a photosensitive layer laminated on the undercoating layer. More specifically, the present invention relates to an electrophotographic photoconductor which has an improved undercoating layer and a method of manufacturing the improved photoconductor.

Electrophotographic photoconductors capable of rapidly producing high-resolution images are widely employed in copying machines, printers and facsimile machines. Many conventional photoconductors use photosensitive inorganic materials, such as selenium, selenium alloys, zinc oxide, and cadmium sulfide. Recently, photoconductors which use photosensitive organic materials have also been developed. These organic photoconductors provide the additional advantages of simple film formation, nontoxicity, light weight and other favorable characteristics. Among the organic photoconductors are the so-called laminate-type organic photoconductors, which include separate charge generation and charge transport layers. By properly choosing optimal material combinations for the layers, the sensitivity of the laminate-type organic photoconductor may be greatly improved. The laminate-type organic photoconductors also permit setting spectroscopic sensitivity at a desired wavelength of exposure light. Because of these and other features, laminate-type organic photoconductors have increasingly been used in electrophotographic apparatuses, such as copying machines, printers and facsimile machines.

Many of the laminate-type organic photoconductors now in practical use include a charge generation layer laminated on a conductive substrate and a charge transport layer laminated on the charge generation layer. The charge generation layer is formed by coating and drying a charge generation dispersion liquid onto a conductive substrate. The charge generation dispersion liquid consists of an organic solvent, into which an organic charge generating agent and a resin binder are dispersed. The charge transport layer is subsequently formed by coating and drying a charge transport dispersion liquid onto the charge generation layer. The charge transport dispersion liquid consists of an organic solvent into which an organic charge transport agent and a resin binder are dispersed.

The basic layer structure described above provides a photoconductor that exhibits the fundamental functions necessary for image formation. In practice, however, it is important to obtain high-quality, defect-free images, and it is also important to maintain high image quality after the photoconductor has been used repeatedly over long periods of time. To meet these requirements, the photosensitive layer must be homogeneous and free from defects. It is also important that the photoconductor exhibit excellent electrical properties. The film quality and electrical properties of the photoconductor should be stable enough to not deteriorate after the photoconductor has been used repeatedly over long periods of time.

The charge generation layer absorbs light to generate electric charge carriers, consisting of an electron and a hole. Since an electrostatic latent image should be formed on the surface of the photoconductor according to the applied field, the holes and the electrons must be quickly injected into the conductive substrate and the charge transport layer, respectively, before annihilation by recombination or trapping occurs in the charge generation layer. Therefore, the charge generation layer should be as thin as possible. The photoconductors now in practical use in electrophotographic apparatuses have charge generation layers as thin as several tenths of a micron or less. Since the charge generation layer must be such a thin film, dirt on the conductive substrate, nonuniformities in the shape and properties of the conductive substrate and surface roughness of the conductive substrate can result in a nonuniform charge generation layer. A nonuniform charge generation layer can result in image defects, such as voids, black spots and/or print density variations.

Usually, the conductive substrate is formed by drawing an aluminum alloy cylindrical tube. Alternatively, the conductive substrate may be formed by cutting and polishing the surface of an aluminum alloy cylindrical tube. In the aluminum alloy substrate, surface roughness differences, surface dirt, differences in the amount and size of the constituent metal precipitates, and uneven oxidation across the substrate surface may result in nonuniformity of the charge generation layer formed on the substrate surface. These nonuniformities in the charge generation layer may adversely affect the image quality.

To avoid nonuniformity in the charge generation layer, an intermediate layer (or undercoating layer) made of a resin with low electrical resistance is interposed between the substrate and the charge generation layer. The intermediate layer also creates a blocking effect that prevents hole injection from the conductive substrate, and thereby avoids diminution in the charge retention capability of the photoconductor.

Solvent-soluble polyamide, polyvinyl alcohol, poly(vinyl butyral), casein, and similar resins are used for the undercoating layer. A resin undercoating layer as thin as 0.1 $\mu$m or less is sufficient to act only as a blocking layer. However, to smooth out variations in the surface profile and properties of the conductive substrate, to cover dirt on the conductive substrate, and to improve the wetness of the coating liquid for the charge generation layer and thereby avoid nonuniform formation of the charge generation layer, the undercoating layer should be as thick as 0.5 $\mu$m or more. Depending on the preparation conditions of the substrate and the degree of contamination of the substrate surface, the undercoating layer may have to be as thick as 1 $\mu$m or more. Such a thick resin layer made of the polyvinyl alcohol, solvent-soluble polyamide, or casein resins described above causes residual potential rise and change of the electrical properties of the photoconductor in extreme temperature and humidity environments. The residual potential rise and electrical property changes in turn cause image defects, such as residual images (called "memories") in a low temperature and low humidity environment, and minute black spots and voids in a high temperature and high humidity environment. The resins described above also absorb considerable amounts of water. Ion conduction by hydrogen ions and hydroxyl ions dissociated from the absorbed water are then responsible for most of the electrical conductance of the resins. Therefore, the electrical resistance of the resin layer could vary greatly, depending on the amount of water contained in the resin layer. This could produce further undesirable variations in image quality.

Various materials have been proposed to create a thick undercoating layer which has low electrical resistance, and which does not Vary with changes in the environmental conditions. The Japanese Unexamined Laid Open Patent Applications (hereinafter referred to as "JULOPA") Nos. H02-193152, H03-288157 and H04-31870 specify the chemical structure of a solvent-soluble polyamide resin. The Japanese Examined Patent Application (hereinafter referred to as "JEPA") No. H02-59458, and JULOPA Nos. H03-150572 and H02-53070 disclose additives that inhibit variations in the electrical resistance of the polyamide resin arising from changes in the environmental conditions. JULOPA Nos. H03-145652, H03-81778 and H02-281262 disclose mixtures of polyamide resin and other resins that allow adjustment of the electrical resistance of the resin, and thereby weaken the influence of environmental changes.

Other materials that may be used in place of polyamide resin include cellulose derivatives (JULOPA No. H02-238459), polyetherurethane (JULOPA Nos. H02-115858 and H02-280170), polyvinylpyrrolidone (JULOPA No. H02-105349) and polyglycolether (JULOPA No. H02-79859). Proposed crosslinked resins whose water content does not vary with changes in the environmental conditions include melamine resin (JULOPA No. H04-22966, and JEPA Nos. H04-31576 and H04-31577) and phenolic resin (JULOPA No. H03-48256).

However, the influences of temperature and humidity are unavoidable, so long as polyamide resins are used as a main constituent of the undercoating layer. Though the other materials mentioned above are effective if the resin layer is very thin, increases in the thickness of the resin layer cause increases in the electrical resistance of the photoconductor. Therefore, residual potential rise still occurs when the resin layer is as thick as several microns.

OBJECTS AND SUMMARY OF THE INVENTION

In view of the foregoing, it is an object of the present invention to overcome the limitations of the prior art.

It is another object of the present invention to provide an electrophotographic photoconductor which includes a thick undercoating layer as an intermediate layer to reduce the influence of the conductive substrate.

It is another object of the present invention to provide an electrophotographic photoconductor whose electrical properties remain constant despite changes in the environmental conditions.

It is still another object of the present invention to provide an electrophotographic photoconductor whose charging characteristics and residual potential remain constant despite repeated use.

It is still another object of the present invention to provide an electrophotographic photoconductor which resists generating image defects due to changes in environmental and operation conditions.

Briefly stated, a laminate type organic electrophotographic photoconductor uses a thick undercoating layer as an intermediate layer for reducing the influence of a conductive substrate on a charge generation layer. An organosilicon coupling agent is bonded to the surfaces of small particles of titanium oxide, zirconium oxide, aluminum oxide or cerium oxide, at an Existence Ratio represented by the peak intensity ratio (Si2p/Me2p, Me=Ti, Zr or Al) or (Si2p/Ce3d) of from 0.15 to 0.6 of a bonding energy spectrum measured by X-ray photoelectron spectroscopy. The metal oxide small particles, the surfaces of which have been treated mechanochemically, are cleaned to reduce the ionic impurity concentration of the undercoating layer to below 1 ppm. The cleaned metal oxide small particles are dispersed into the polyamide copolymer binder resin for the undercoating layer. The undercoating layer produced in this manner results in a electrophotographic photoconductor whose electrical properties are constant despite environmental changes and repeated use. The electrophotographic photoconductor also resists residual potential rise after repeated use, and also resists image defect formation despite changes in environmental conditions and operating conditions.

According to an embodiment of the present invention, there is provided an electrophotographic photoconductor, comprising a conductive substrate; an undercoating layer on the conductive substrate, the undercoating layer comprising binder resin; a photoconductive layer on the undercoating layer; particles of at least one metal oxide selected from the group consisting of titanium oxide, zirconium oxide, and aluminum oxide, the particles being dispersed in the binder resin; a coupling agent; the coupling agent being an organosilicon compound; the coupling agent being bonded to the particles' surfaces at an Existence Ratio expressed as a peak intensity ratio of bonding energy spectra produced by X-ray photoelectron spectroscopic analysis; the peak intensity ratio being a peak intensity ratio of the 2p electron of silicon atom and the 2p electron of the metal in the metal oxide; the peak intensity ratio being from 0.15 to 0.6; and the undercoating layer containing not more than 1 ppm of ionic impurities.

According to another embodiment of the present invention, there is provided an electrophotographic photoconductor, comprising a conductive substrate; an undercoating layer on the conductive substrate, the undercoating layer comprising binder resin; a photoconductive layer on the undercoating layer; particles of cerium oxide, the particles being dispersed in the binder resin; a coupling agent; the coupling agent being an organosilicon compound; the coupling agent being bonded to the particles' surfaces at an Existence Ratio expressed as a peak intensity ratio of bonding energy spectra produced by X-ray photoelectron spectroscopic analysis; the peak intensity ratio being a peak intensity ratio of the 2p electron of silicon atom and the 3d electron of the cerium in the cerium oxide; the peak intensity ratio being from 0.15 to 0.6; and the undercoating layer containing not more than 1 ppm of ionic impurities.

According to another embodiment of the present invention, there is provided a method of manufacturing an electrophotographic photoconductor including a conductive substrate; an undercoating layer on the conductive substrate, the undercoating layer comprising binder resin; a photoconductive layer on the undercoating layer; particles of at least one metal oxide selected from the group consisting of titanium oxide, zirconium oxide, aluminum oxide and cerium oxide, the particles being dispersed in the binder resin; a coupling agent of an organosilicon compound, the coupling agent being bonded to the particles' surfaces at an X-ray photoelectron spectroscopic Existence Ratio of from 0.15 to 0.6; and not more than 1 ppm of ionic impurities contained in the undercoating layer, comprising the steps of preparing a mixture of the at least one metal oxide particles and the organosilicon coupling agent; and applying vapor phase surface treatment to the mixture, whereby the organosilicon coupling agent is mechanochemically bonded to the surfaces of the particles.

The above, and other objects, features and advantages of the present invention will become apparent from the following description.

DETAILED DESCRIPTION OF THE PREFERRED EMBODIMENT

For the undercoating layer of the present invention, it is preferable to include metal oxide small particles whose surfaces have been treated with an organosilicon compound. More preferably, the organosilicon compound is an aminosilane compound. The metal oxide is preferably at least one selected from the group consisting of titanium oxide, zirconium oxide, aluminum oxide and cerium oxide. The amount of Si atoms bonded to the surfaces of the metal oxide small particles is set within a predetermined range of the existence ratio of Si and metal atoms by vapor phase treatment of the metal oxide small particle surfaces with an organosilicon compound, and the treated metal oxide small particles are mixed in an undercoating layer which includes polyamide resin binder. The metal oxide small particles treated by the method of the present invention disperse very well into the binder resin, and an undercoating layer with excellent uniformity is obtained.

The surface properties of the small particles are improved by coating and adsorbing a coupling agent onto the small particles. One conventional method of treating metal oxide small particle surfaces adds a coupling agent solution to metal oxide. Another conventional method pulverizes a coupling agent and metal oxide powder in a bowl mill. The conventional surface treatment methods do not uniformly treat the surfaces of the metal oxide particles, and also fail to remove secondary aggregates of the untreated small particles. Therefore, when metal oxides coated by the conventional methods are used as a filler in the undercoating layer of an organic photoconductor, image defects are generated in a high temperature and humidity environment (35° C., 85% relative humidity).

The vapor phase method of the present invention treats metal oxide surfaces by exerting impact force to the coupling agent and metal oxide powder in a jet stream. The JULOPA No. 62-087237 discloses this method in detail. Briefly, the powder and the coupling agent are mixed, and then the mixture is impacted by a pressurized fluid, such as air. This vapor phase surface treatment results in uniform treatment of the metal oxide surfaces and dispersion of the metal oxide into the binder, without causing grain growth and aggregation. Operation of a electrophotographic photoconductor which includes the undercoating layer of the present invention does not produce any image defects, such as small black spots and voids, in extreme temperature and humidity environments.

For the undercoating layer, it is preferable to use polyamide resin as the binder resin. The copolymerized polyamide may be a cycloaliphatic polyamide or a heterocyclic polyamide and may further be substituted. The copolymerized polyamide may also be bound to another monomeric unit by an ether linkage. A polyamide resin comprising an isophorone ring, a piperazine ring, a cyclohexyl ring, polyalkyleneetherpolyamide, or a crosslinked resin obtained by crosslinking any of these polyamide resins is preferable. For the crosslinking agent of the polyamide resins, a urea resin, a melamine resin, a benzoguanamine resin, an epoxy resin, or an isocyanate resin may be used, as well as mixtures and copolymers of these resins. Ten to 500 weight parts of metal oxide may be used to 100 weight parts of any of these resins, mixtures, or copolymers.

For treating the small grain surfaces of any of the metal oxides listed above by the vapor phase method, aminosilane compounds are preferably used as the coupling agent. The aminosilane compounds preferable for use as the coupling agent include N-β-aminoethyl-γ-aminopropyltrimethoxysilane, γ-aminopropyltrimethoxysilane, and N-phenyl-γ-aminopropyltrimethoxysilane The coupling agents described above are used to treat the metal oxide small particle surfaces by the vapor phase method. Specifically, the coupling agent and the metal oxide powder are first mixed in a blender, such as a bowl mill or a penshell mixer. Then the mixture is pulverized in an air jet type crusher, such as a jet mill. Anatase-type titanium dioxide is the preferable form of titanium oxide to be treated with an organosilicon compound, since the electrical resistance of anatase-type titanium dioxide is relatively low, and the dispersion stability of anatase-type titanium dioxide is excellent.

From 0.1 to 10 weight parts, more preferably from 1 to 6 weight parts, of organosilicon coupling agent is used for the surface treatment of the small grains of any of the metal oxides listed above. The treated metal oxide small particles surfaces are analyzed by X-ray photoelectron spectroscopy (hereinafter "XPS"). XPS is also referred to in the art as ESCA, for Electron Spectroscopy for Chemical Analysis. Discussions of XPS may be found in INSTRUMENTAL METHODS OF ANALYSIS, Sixth Edition, "Electron Spectroscopy for Chemical Analysis", pages 394–402, and CHARACTERIZATION OF METAL AND POLYMER SURFACES, Vol. 1-Metal Surfaces, "Surface Characterization Using Electron Spectroscopy, pages 399–430, the entireties of which are hereby incorporated by reference. The "Existence Ratio" of the organosilicon coupling agent on the metal oxide small particles surfaces is defined as the peak intensity ratio in the bonding energy spectrum of the 2p electron of silicon atom (Si2p) to that of the 2p electron of metal atom (Me2p), or the peak intensity ratio in the bonding energy spectrum of the 2p electron of silicon atom (Si2p) to that of the 3d electron of cerium atom (Ce3d). In other words, the Existence Ratio may be expressed as either Si2p/Me2p, where Me=Ti, Zr or Al, or as Si2p/Ce3d. An Existence Ratio of between 0.15 to 0.60 is desirable. When the ratio is less than 0.15, the dispersibility of the metal oxide small particles is reduced, and the metal oxide small particles tend to aggregate. When the peak intensity ratio is greater than 0.60, excess organosilicon compound covering the metal oxide small particle surfaces hinders the contribution of the metal oxide to the electrical conduction, and produces an undercoating layer having high electrical resistance. This results in residual potential rise in the photoconductor, which produces memory phenomena in the electrophotographic images. When the Existence Ratio of the organosilicon coupling agent is within the above described range, the metal oxide small particles are well dispersed within the polyamide resin. An undercoating layer containing well dispersed metal oxide particles provides a photoconductor that exhibits stable image quality regardless of the environmental conditions.

It is desirable for the metal oxide to be free of any ionic impurities. Ionic impurities such as $Na^+$, $K^+$, $Ca^{2+}$, $Cl^-SO_4^{2-}$, $SO_3^{2-}$ and $PO_4^{3-}$ tend to mix into the metal oxide during the preparation of the metal oxide. The ionic impurities are eluted into the undercoating layer, and cause minute black spots and voids by lowering the electrical resistance of the undercoating layer, particularly at high temperature and high humidity. In the present invention, the ionic impurity content is preferably less than 1 ppm. The ionic impurities can be removed easily by washing the metal oxide small particles with pure water.

The preferable average particle diameter of the metal oxide small particles is around one-half of the wavelength of the electrophotographic apparatus' exposure light. When the average particle diameter is less than a half of the exposure light wavelength, the undercoating layer is transparent to the exposure light. Then, where the reflected light from the conductive substrate and the incident light meet, optical interference is produced in the undercoating layer. When a laser beam is used for the exposure light, interference fringes are produced in the image. Since ordinary electrophotographic apparatuses use visible light or a laser beam from a semiconductor laser, such interference can be avoided by scattering the light, using small particles of between about 200 and about 600 nm in diameter. Additionally, when the concentration of the small particles which are capable of scattering the light is low, the light is not scattered effectively. Therefore, it is preferable that the diameters of 30 weight % or more of the metal oxide small particles fall within the effective scattering size range.

The effective thickness of the undercoating layer is from 0.1 to 20 μm, and more effectively from 0.1 to 10 μm. Though a laminate-type or a dispersion-type photoconductive layer may be disposed on the undercoating layer, a laminate-type photoconductive layer is preferable to enhance the effect of the present invention.

The charge generating agents used in the charge generation layer of laminate-type photoconductors include inorganic photoconductive materials such as selenium, selenium alloys and cadmium sulfide. The charge generation layer may also comprise organic photoconductive materials, such as phthalocyanine pigment, azo pigment, quinacridone pigment, indigo pigment, perylene pigment, polycyclic quinone pigment, anthanthron pigment and benzimidazole pigment. Small particles of these charge generating agents are mixed into a suitable binder resin, such as polyester resin, poly(vinyl acetate) resin, polyacrylate resin, polymethacrylate resin, polycarbonate resin, poly(vinyl acetoacetal) resin, poly(vinyl propional) resin, poly(vinyl butyral) resin, phenoxy resin, epoxy resin, urethane resin, cellulose ester resin, and cellulose ether resin. From 30 to 500 weight parts of charge generating agent are mixed to 100 weight parts of binder resin. The preferable thickness of the charge generating layer is from 0.15 to 0.6 μm.

The charge transport layer is formed from a coating liquid into which a charge transport agent is dispersed or dissolved with a resin binder. Enamine compounds, styryl compounds, hydrazone compounds, amine compounds, and butadiene compounds may be used as the charge transport agent. Resins compatible with the charge transport agent are used as the binder resin. Such resins may include polyester resin, polycarbonate resin, polystyrene resin, polyacrylate resin and polymethacrylate resin. The coating liquid for the charge transport layer is coated to a dry thickness of from 10 to 40 μm. If necessary, various additives such as antioxidants, ultraviolet absorbing agents and/or leveling agents may be added to the coating liquid.

Embodiments A1–A13, Comparative Examples A1–A13

Comparative Example A1

Titanium oxide small particles (P25, 25 nm in particle diameter; from Nippon Aerosil Co., Ltd.), were washed with pure water and dried well. Coating liquid for the undercoating layer was prepared by dispersing the titanium oxide small particles into a methanol solution of polyamide resin (Amilan CM 8000, from TORAY INDUSTRIES, INC.). The coating liquid was coated onto an aluminum cylindrical substrate tube by dip- coating, and dried to form an undercoating layer of 3 μm in thickness.

XPS analysis was conducted in an ESCA-1000 (Shimadzu Corp.), using Mg-K radiation from a magnesium target, an acceleration voltage for the X-ray source of 10 kV, and a power supply current of 20 mA. XPS analysis of the bonding energy spectrum of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Coating liquid for the charge generation layer was prepared by dispersing and dissolving 1 weight part of X-type metal-free phthalocyanine and 1 weight part of a vinylchloride copolymer resin (MR110, from Nippon Zeon Co., Ltd.) into 100 weight parts of dichloromethane. A charge generation layer was formed by coating the coating liquid on the undercoating layer. The coating liquid was then dried to a thickness of 0.2 μm.

Coating liquid for the charge transport layer was prepared by dissolving 1 weight part of a hydrazone compound (CTC191, from Anan Perfume Industries, Ltd.) and 1 weight part of a polycarbonate resin (Panlite L-1225, from TEIJIN LTD.) into 10 weight parts of dichloromethane. The coating liquid was coated onto the charge generation layer and dried to form a charge transport layer of 20 μm in thickness.

Embodiment A1

Five weight parts of γ-aminopropyltriethoxysilane were coupled mechanochemically by the vapor phase method to the surfaces of 100 weight parts of titanium dioxide small particles (P25, 25 nm in particle diameter; from Nippon Aerosil Co., Ltd.). The titanium oxide small particles, the surfaces of which had been treated, were cleaned with pure water and dried well. The cleaned titanium oxide small particles were dispersed into the polyamide resin of the comparative example A1 to form an undercoating layer. A photoconductor of the embodiment A1 was fabricated in a similar manner as the comparative example A1, except for the undercoating layer. The bonding energy spectrum of the surface aminosilanated titanium oxide small particles, measured by XPS, revealed a peak intensity ratio (Si2p/Ti2p) of the 2p electrons of Si atom and Ti atom of 0.25. The concentration of ionic impurities, measured by ion chromatography, was less than 1 ppm.

Embodiment A2

Ten weight parts of γ-aminopropyltriethoxysilane were coupled by the vapor phase method to the surfaces of 100 weight parts of titanium oxide small particles (P25, 25 nm in particle diameter; from Nippon Aerosil Co., Ltd.). The titanium oxide small particles, the surfaces of which had been treated, were cleaned with pure water and dried well. The cleaned titanium oxide small particles were dispersed into the polyamide resin of the comparative example A1 to form an undercoating layer. A photoconductor of the embodiment A2 was fabricated in a similar manner as the comparative example A1, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by ion chromatography, was less than 1 ppm.

Comparative Example A2

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide resin of the comparative example A1 to form an undercoating layer. A photoconductor of the comparative example A2 was fabricated in a similar manner as the comparative example A1, except for the undercoating layer. The bonding energy spectrum of the surface aminosilanated titanium oxide small particles revealed a peak intensity ratio (Si2p/Ti2p) of the 2p electrons of Si atom and Ti atom of 0.64. The concentration of the ionic impurities, measured by ion chromatography, was less than 1 ppm.

Comparative Example A3

Diamine adipate having the following structure was synthesized by cyanoethylizing and reducing polyethylene glycol having an average polymerization degree of 13.

$$H_2N(CH_2)_3(OCH_2CH_2)_{13}O(CH_2)_3NH_2$$

Copolymerized polyamide with a relative viscosity of 2.2 was obtained by cocondensation-polymerization of 100 weight parts of the foregoing diamine adipate and 42 weight parts of ϵ-caprolactam. NMR analysis revealed the polyamide copolymer had the following structure:

$$-[CO(CH_2)_5NH]_8 [CO(CH_2)_4CONH(CH_2)_3(OCH_2CH_2)_{13}O(CH_2)_3NH_2]_n-$$

One gram of the polyamide was dissolved into 100 ml of 98% sulfuric acid, and the relative viscosity of the polyamide was measured at 25 ° C.

Titanium oxide small particles (P25, 25 nm in particle diameter; from Nippon Aerosil Co., Ltd.) were washed with pure water and dried well. Coating liquid for the undercoating layer was prepared by dispersing the cleaned titanium oxide small particles into a methanol solution of the polyether polyamide resin. An undercoating layer was formed by dip coating and drying the coating liquid onto a cylindrical aluminum substrate tube. The dried undercoating layer was 3 μm in thickness.

A photoconductor of the comparative example A3 was fabricated in a similar manner as the comparative example A1, except for the undercoating layer. The bonding energy spectrum obtained by XPS analysis of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Embodiment A3

Five weight parts of γ-aminopropyltriethoxysilane were coupled to the surfaces of 100 weight parts of titanium oxide small particles (P25, from Nippon Aerosil Co., Ltd.) by the vapor phase method. The titanium oxide small particles, the surfaces of which had been treated, were cleaned with pure water and dried well. The cleaned titanium oxide small particles were dispersed into the polyether polyamide resin of the comparative example A3 to form an undercoating layer. A photoconductor of the embodiment A3 was fabricated in a similar manner as the comparative example A3, except for the undercoating layer. The bonding energy spectrum of the surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

Embodiment A4

Ten weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyether polyamide resin of the comparative example A3 to form an undercoating layer. A photoconductor of the embodiment A4 was fabricated in a similar manner as the comparative example A3, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by ion chromatography, was less than 1 ppm.

Comparative Example A4

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyether polyamide resin of the comparative example A3 to form an undercoating layer. A photoconductor of the comparative example A4 was fabricated in a similar manner as the comparative example A3, except for the undercoating layer. The bonding energy spectrum of the surface aminosilanated titanium oxide small particles revealed a peak intensity ratio (Si2p/Ti2p) of the 2p electrons of Si atom and Ti atom of 0.64. The concentration of the ionic impurities, measured by ion chromatography, was less than 1 ppm.

Comparative Example A5

Copolymerized polyamide with a relative viscosity of 2.0 was obtained by condensation-polymerization of 100 weight parts of isophoronediamine adipate and 11 weight parts of ϵ-caprolactam. NMR analysis revealed that the resulting polyamide copolymer had the following structure.

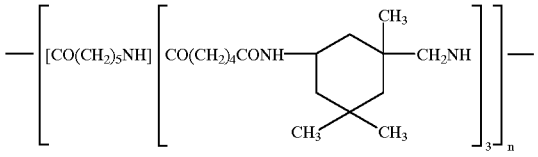

Titanium oxide small particles (P25 supplied from Nippon Aerosil Co., Ltd.) were washed with pure water and dried well. Coating liquid for the undercoating layer was prepared by dispersing the cleaned titanium oxide small particles into a methanol solution of the polyamide copolymer resin. An undercoating layer was formed by dip coating and drying the coating liquid on a cylindrical aluminum substrate tube. The dried undercoating layer was 3 μm in thickness.

A photoconductor of the comparative example A5 was fabricated in a similar manner as the comparative example A1, except for the undercoating layer. The bonding energy spectrum obtained by XPS analysis of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Embodiment A5

Five weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A5 to form an undercoating layer. A photoconductor of the embodiment A5 was fabricated in a similar manner as the comparative example A5, except for the undercoating layer. The bonding energy spectrum of the surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

Embodiment A6

Ten weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A5 to form an undercoating layer. A photoconductor of the embodiment A6 was fabricated in a similar manner as the comparative example A5, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by ion chromatography, was less than 1 ppm.

Comparative Example A6

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A5 to form an undercoating layer. A photoconductor of the comparative example A6 was fabricated in a similar manner as the comparative example A5, except for the undercoating layer. The bonding energy spectrum of the surface aminosilanated titanium oxide small particles revealed a peak intensity ratio (Si2p/Ti2p) of the 2p electrons of Si atom and Ti atom of 0.64. The concentration of the ionic impurities, measured by ion chromatography, was less than 1 ppm.

Comparative Example A7

Copolymerized polyamide with relative viscosity of 2.5 was obtained by condensation-polymerization of a mixture of 2-aminoethylpiperazine adipate and ε-caprolactam. NMR analysis revealed that the weight ratio of the copolymer portion was 100/17.

Titanium oxide small particles (P25, from Nippon Aerosil Co., Ltd.) were washed with pure water and dried well. Coating liquid for the undercoating layer was prepared by dispersing the cleaned titanium oxide small particles into a methanol solution of the polyamide copolymer resin. An undercoating layer was formed by dip coating and drying the coating liquid on a cylindrical aluminum substrate tube. The dried undercoating layer was 3 μm in thickness.

A photoconductor of the comparative example A7 was fabricated in a similar manner as the comparative example A1, except for the undercoating layer. The bonding energy spectrum obtained by XPS analysis of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Embodiment A7

Five weight parts of γ-aminopropyltriethoxysilane were coupled mechanochemically to the surfaces of 100 weight parts of titanium oxide small particles (P25, from Nippon Aerosil Co., Ltd.) by the vapor phase method. The titanium oxide small particles, the surfaces of which had been treated, were cleaned with pure water and dried well. The cleaned titanium oxide small particles were dispersed into the polyamide copolymer resin of the comparative example A7 to form an undercoating layer. A photoconductor of the embodiment A7 was fabricated in a similar manner as the comparative example A7, except for the undercoating layer. The bonding energy spectrum of the surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

Embodiment A8

Ten weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A7 to form an undercoating layer. A photoconductor of the embodiment A8 was fabricated in a similar manner as the comparative example A7, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by the ion chromatography, was less than 1 ppm.

Comparative Example A8

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A7 to form an undercoating layer. A photoconductor of the comparative example A8 was fabricated in a similar manner as the comparative example A7, except for the undercoating layer. The bonding energy spectrum of the surface aminosilanated titanium oxide small particles revealed a peak intensity ratio (Si2p/ti2p) of the 2p electrons of Si atom and Ti atom of 0.64. The concentration of the ionic impurities, measured by ion chromatography, was less than 1 ppm.

Comparative Example A9

Copolymerized polyamide with relative viscosity of 1.8 was obtained by condensation-polymerization of a mixture of ε-caprolactam and adipate of 1,3-bis(aminomethyl) cyclohexane. NMR analysis revealed that the weight ratio of the copolymer portion was 100/20.

Titanium oxide small particles (P25, from Nippon Aerosil Co., Ltd.) were washed with pure water and dried well. Coating liquid for the undercoating layer was prepared by dispersing the cleaned titanium oxide into a methanol solution of the polyamide copolymer resin. An undercoating layer was formed by dip coating and drying the coating liquid on a cylindrical aluminum substrate tube. The dried undercoating layer was 3 μm in thickness.

A photoconductor of the comparative example A9 was fabricated in a similar manner as the comparative example A1, except for the undercoating layer. The bonding energy spectrum obtained by XPS analysis of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Embodiment A9

Five weight parts of γ-aminopropyltriethoxysilane were coupled mechanochemically to the surfaces of 100 weight parts of titanium oxide small particles (P25, from Nippon Aerosil Co., Ltd.) by the vapor phase method. The titanium oxide small particles, the surfaces of which had been treated, were cleaned with pure water and dried well. The cleaned titanium oxide small particles were dispersed into the polyamide copolymer resin of the comparative example A9 to form an undercoating layer. A photoconductor of the embodiment A9 was fabricated in a similar manner as the comparative example A9, except for the undercoating layer. The bonding energy spectrum of the surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

Embodiment A10

Ten weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A9 to form an undercoating layer. A photoconductor of the embodiment A10 was fabricated in a similar manner as the comparative example A9, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by ion chromatography, was less than 1 ppm.

Comparative Example A10

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A9 to form an undercoating layer. A photoconductor of the comparative example A10 was fabricated in a similar manner as the comparative example A9, except for the undercoating layer. The bonding energy spectrum of the surface aminosilanated titanium oxide small particles revealed a peak intensity ratio (Si2p/Ti2p) of the 2p electrons of Si atom and Ti atom of 0.64. The concentration of the ionic impurities, measured by ion chromatography, was less than 1 ppm.

Comparative Example A11

Copolymerized polyamide with relative viscosity of 2.4 was obtained by condensation-polymerization of a mixture of ε-caprolactam and adipate of 4,4-diaminodihexylmethane. NMR analysis revealed that the weight ratio of the copolymer portion was 70/30.

Titanium oxide small particles (P25, from Nippon Aerosil Co., Ltd.) were washed with pure water and dried well. Coating liquid for the undercoating layer was prepared by dispersing the cleaned titanium oxide into a methanol solution of the polyamide copolymer resin. An undercoating layer was formed by dip coating and drying the coating liquid on a cylindrical aluminum substrate tube. The dried undercoating layer was 3 μm in thickness.

A photoconductor of the comparative example A11 was fabricated in a similar manner as the comparative example A1, except for the undercoating layer. The bonding energy spectrum obtained by XPS analysis of the titanium oxide small particles revealed a peak intensity ratio (Si2p/Ti2p) of the 2p electrons of Si atom (Si2p) and Ti atom (Ti2p) of 0.03. The peak intensity of the 2p electron of the Si atom was within the noise level of this specimen, and the peak intensity ratio (Si2p/Ti2p) was therefore deemed to be substantially zero. The concentration of the ionic impurities, measured by ion chromatography, was less than 1 ppm.

Embodiment A11

Five weight parts of γ-aminopropyltriethoxysilane were coupled mechanochemically to the surfaces of 100 weight parts of titanium oxide small particles (P25, from Nippon Aerosil Co., Ltd.) by the vapor phase method. The titanium oxide small particles, the surfaces of which had been treated, were cleaned with pure water and dried well. The cleaned titanium oxide small particles were dispersed into the polyamide copolymer resin of the comparative example A11 to form an undercoating layer. A photoconductor of the embodiment A11 was fabricated in a similar manner as the comparative example A11, except for the undercoating layer. The bonding energy spectrum of the surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

Embodiment A12

Ten weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A11 to form an undercoating layer. A photoconductor of the embodiment A12 was fabricated in a similar manner as the comparative example A11, except for the undercoating layer. The bonding energy spectrum of the surface aminosilanated titanium oxide small particles revealed a peak intensity ratio (Si2p/Ti2p) of the 2p electrons of Si atom and Ti atom of 0.48. The concentration of the ionic impurities, measured by ion chromatography, was less than 1 ppm.

Comparative Example A12

Fifteen weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were cleaned with pure water and dried well. The cleaned titanium oxide small particles were dispersed into the polyamide copolymer resin of the comparative example A11 to form an undercoating layer. A photoconductor of the comparative example A12 was fabricated in a similar manner as the comparative example A11, except for the undercoating layer. The bonding energy spectrum of the surface aminosilanated titanium oxide small particles revealed a peak intensity ratio (Si2p/Ti2p) of the 2p electrons of Si atom and Ti atom of 0.64. The concentration of the ionic impurities, measured by ion chromatography, was less than 1 ppm.

Comparative Example A13

Five weight parts of γ-aminopropyltriethoxysilane were coupled by the vapor phase method to the surfaces of 100 weight parts of titanium oxide small particles (P25, from Nippon Aerosil Co., Ltd.). The titanium oxide small particles, the surfaces of which had been treated, were used in an undercoating layer without cleaning. A photoconductor of the comparative example A13 was fabricated in a similar manner as the comparative example A1, except for the treatment of the titanium oxide small particles. The bonding energy spectrum of the surface aminosilanated titanium oxide small particles revealed a peak intensity ratio (Si2p/Ti2p) of the 2p electrons of Si atom and Ti atom of 0.26. Sodium ion concentration, detected by ion chromatography, was 2 ppm. The concentrations of the other ionic impurities were less than 1 ppm.

Embodiment A13

Five weight parts of γ-aminopropyltriethoxysilane were coupled by the vapor phase method to the surfaces of 50 weight parts of titanium oxide small particles (P25, from Nippon Aerosil Co., Ltd.) and 50 weight parts of titanium oxide small particles (TAF-300J, from Fuji Titanium Industry Co., Ltd.). The titanium oxide small particles, the surfaces of which had been treated, were cleaned with pure water and dried well. The cleaned titanium oxide small particles were dispersed into the polyamide resin of the undercoating layer.

A photoconductor of the embodiment A13 was fabricated in a similar manner as the comparative example A1, except for the mixed titanium oxide small particles in the undercoating layer. The bonding energy spectrum of the mixed surface aminosilanated titanium oxide small particles revealed a peak intensity ratio (Si2p/Ti2p) of the 2p electrons of Si atom and Ti atom of 0.25. The concentration of the ionic impurities, measured by ion chromatography, was less than 1 ppm.

The photoconductors fabricated as described above were mounted in a commercial laser beam printer. Images were printed in a high temperature and high humidity environment (35° C., humidity 85%) and a low temperature and low humidity environment (5° C., humidity 30%) to evaluate occurrence of small black spots and memory phenomena. The results were classified into three categories:

○: Excellent

X: Problematic

XX: Very problematic

Half tone images were printed in an environment of ordinary temperature and ordinary humidity (22° C., humidity 50%) to determine whether interference fringes were produced. A "+" sign indicates interference fringes were detected; a "−" sign indicates lack of detectable interference fringes.

TABLE 1

| | High temp + high humidity-Small black spots | Low temp + low humidity-Memory effects | Interference fringes | Peak ratio Si(2p)/Ti(2p) | Ionic Impurities |
|---|---|---|---|---|---|
| Comparative A1 | xx | ○ | + | 0.03 | <1 ppm |
| Embodiment A1 | ○ | ○ | + | 0.25 | <1 ppm |
| Embodiment A2 | ○ | ○ | + | 0.48 | <1 ppm |
| Comparative A2 | ○ | x | + | 0.64 | <1 ppm |
| Comparative A3 | x | ○ | + | 0.03 | <1 ppm |
| Embodiment A3 | ○ | ○ | + | 0.25 | <1 ppm |
| Embodiment A4 | ○ | ○ | + | 0.48 | <1 ppm |
| Comparative A4 | ○ | xx | + | 0.64 | <1 ppm |
| Comparative A5 | x | ○ | + | 0.03 | <1 ppm |
| Embodiment A5 | ○ | ○ | + | 0.25 | <1 ppm |
| Embodiment A6 | ○ | ○ | + | 0.48 | <1 ppm |
| Comparative A6 | ○ | xx | + | 0.64 | <1 ppm |
| Comparative A7 | x | ○ | + | 0.03 | <1 ppm |
| Embodiment A7 | ○ | ○ | + | 0.25 | <1 ppm |
| Embodiment A8 | ○ | ○ | + | 0.48 | <1 ppm |
| Comparative A8 | ○ | x | + | 0.64 | <1 ppm |
| Comparative A9 | x | ○ | + | 0.03 | <1 ppm |
| Embodiment A9 | ○ | ○ | + | 0.25 | <1 ppm |
| Embodiment A10 | ○ | ○ | + | 0.48 | <1 ppm |
| Comparative A10 | ○ | x | + | 0.64 | <1 ppm |
| Comparative A11 | x | ○ | + | 0.03 | <1 ppm |
| Embodiment A11 | ○ | ○ | + | 0.25 | <1 ppm |
| Embodiment A12 | ○ | ○ | + | 0.48 | <1 ppm |
| Comparative A12 | ○ | x | + | 0.64 | <1 ppm |
| Comparative A13 | xx | ○ | + | 0.26 | 2 ppm $Na^+$ |
| Embodiment A13 | 0 | 0 | − | 0.25 | <1 ppm |

Embodiments B1–B13, Comparative Examples B1–B13

The photoconductors of embodiments B1 through B13 and comparative examples B1 through B13 were fabricated in a similar manner as the photoconductors of embodiments A1 through A13 and comparative examples A1 through A13, except that zirconium oxide was used in place of titanium oxide. Prototype samples of zirconium oxide (30 nm particle diameter, from Nippon Aerosil Co., Ltd.) were used, except in embodiment B13. In embodiment B13, 50 weight parts of the prototype zirconium oxide were mixed with 50 weight parts of another zirconium oxide of 500 nm particle diameter (FZ-05, from Fujimi Abrasive Industry Co., Ltd.). The photoconductors of embodiments Bi through B13 and comparative examples B1 through B13 were tested and evaluated in the same manner as the photoconductors of embodiments A1 through A13 and comparative examples A1 through A13. Table 2 lists the results of the evaluation.

TABLE 2

| | High temp + high humidity-Small black spots | Low temp + low humidity-Memory effects | Interference fringes | Peak ratio Si(2p)/Zr(2p) | Ionic Impurities |
|---|---|---|---|---|---|
| Comparative B1 | xx | ○ | + | 0.03 | <1 ppm |
| Embodiment B1 | ○ | ○ | + | 0.25 | <1 ppm |
| Embodiment B2 | ○ | ○ | + | 0.48 | <1 ppm |
| Comparative B2 | ○ | x | + | 0.64 | <1 ppm |
| Comparative B3 | x | ○ | + | 0.03 | <1 ppm |
| Embodiment B3 | ○ | ○ | + | 0.25 | <1 ppm |
| Embodiment B4 | ○ | ○ | + | 0.48 | <1 ppm |
| Comparative B4 | ○ | xx | + | 0.64 | <1 ppm |
| Comparative B5 | x | ○ | + | 0.03 | <1 ppm |
| Embodiment B5 | ○ | ○ | + | 0.25 | <1 ppm |
| Embodiment B6 | ○ | ○ | + | 0.48 | <1 ppm |
| Comparative B6 | ○ | xx | + | 0.64 | <1 ppm |
| Comparative B7 | x | ○ | + | 0.03 | <1 ppm |
| Embodiment B7 | ○ | ○ | + | 0.25 | <1 ppm |
| Embodiment B8 | ○ | ○ | + | 0.48 | <1 ppm |
| Comparative B8 | ○ | x | + | 0.64 | <1 ppm |
| Comparative B9 | x | ○ | + | 0.03 | <1 ppm |
| Embodiment B9 | ○ | ○ | + | 0.25 | <1 ppm |
| Embodiment B10 | ○ | ○ | + | 0.48 | <1 ppm |
| Comparative B10 | ○ | x | + | 0.64 | <1 ppm |
| Comparative B11 | x | ○ | + | 0.03 | <1 ppm |
| Embodiment B11 | ○ | ○ | + | 0.25 | <1 ppm |
| Embodiment B12 | ○ | ○ | + | 0.48 | <1 ppm |
| Comparative B12 | ○ | x | + | 0.64 | <1 ppm |
| Comparative B13 | xx | ○ | + | 0.26 | 2 ppm $Na^+$ |
| Embodiment B13 | ○ | ○ | − | 0.25 | <1 ppm |

Embodiments C1–C13, Comparative Examples C1–C13

The photoconductors of embodiments C1 through C13 and comparative examples C1 through C13 were fabricated in a similar manner as the photoconductors of embodiments A1 through A13 and comparative examples A1 through A13, except that aluminum oxide was used in place of titanium oxide. Aluminum oxide having a particle diameter of 13 nm (Aluminum Oxide C, from Nippon Aerosil Co., Ltd.) was used, except in embodiment C13. In embodiment C13, 50 weight parts of the aluminum oxide was mixed with 50 weight parts of another aluminum oxide of 500 nm particle diameter (FS A-D-20, from Fujimi Abrasive Industry Co., Ltd.). The photoconductors of embodiments C1 through C13 and comparative examples C1 through C13 were tested and evaluated in the same manner as the photoconductors of embodiments A1 through A13 and comparative examples A1 through A13. Table 3 lists the results of the evaluation.

TABLE 3

| | High temp + high humidity-Small black spots | Low temp + low humidity-Memory effects | Interference fringes | Peak ratio Si(2p)/Al(2p) | Ionic Impurities |
|---|---|---|---|---|---|
| Comparative C1 | xx | ○ | + | 0.03 | <1 ppm |
| Embodiment C1 | ○ | ○ | + | 0.25 | <1 ppm |
| Embodiment C2 | ○ | ○ | + | 0.48 | <1 ppm |
| Comparative C2 | ○ | x | + | 0.64 | <1 ppm |
| Comparative C3 | x | ○ | + | 0.03 | <1 ppm |
| Embodiment C3 | ○ | ○ | + | 0.25 | <1 ppm |
| Ewbodiment C4 | ○ | ○ | + | 0.48 | <1 ppm |
| Comparative C4 | ○ | xx | + | 0.64 | <1 ppm |
| Comparative C5 | x | ○ | + | 0.03 | <1 ppm |
| Embodiment C5 | ○ | ○ | + | 0.25 | <1 ppm |
| Embodiment C6 | ○ | ○ | + | 0.48 | <1 ppm |
| Comparative C6 | ○ | xx | + | 0.64 | <1 ppm |
| Comparative C7 | x | ○ | + | 0.03 | <1 ppm |
| Embodiment C7 | ○ | ○ | + | 0.25 | <1 ppm |
| Embodiment C8 | ○ | ○ | + | 0.48 | <1 ppm |
| Comparative C8 | ○ | x | + | 0.64 | <1 ppm |

TABLE 3-continued

| | High temp + high humidity-Small black spots | Low temp + low humidity-Memory effects | Interference fringes | Peak ratio Si(2p)/Al(2p) | Ionic Impurities |
|---|---|---|---|---|---|
| Comparative C9 | x | ○ | + | 0.03 | <1 ppm |
| Embodiment C9 | ○ | ○ | + | 0.25 | <1 ppm |
| Embodiment C10 | ○ | ○ | + | 0.48 | <1 ppm |
| Comparative C10 | ○ | x | + | 0.64 | <1 ppm |
| Comparative C11 | x | ○ | + | 0.03 | <1 ppm |
| Embodiment C11 | ○ | ○ | + | 0.25 | <1 ppm |
| Embodiment C12 | ○ | ○ | + | 0.48 | <1 ppm |
| Comparative C12 | ○ | x | + | 0.64 | <1 ppm |
| Comparative C13 | xx | ○ | + | 0.26 | 2 ppm $Na^+$ |
| Embodiment C13 | ○ | ○ | – | 0.25 | <1 ppm |

Embodiments D1–D13, Comparative Examples D1–D13

The photoconductors of embodiments D1 through D13 and comparative examples D1 through D13 were fabricated in a similar manner as the photoconductors of embodiments A1 through A13 and comparative examples A1 through A13, except that cerium oxide (FR, 500 nm in particle diameter, from Fujimi Abrasive Industry Co., Ltd.) was used in place of titanium oxide. The photoconductors of embodiments D1 through D13 and comparative examples D1 through D13 were tested and evaluated in the same manner as the photoconductors of embodiments A1 through A13 and comparative examples A1 through A13. Table 4 lists the results of the evaluation.

TABLE 4

| | High temp + high humidity-Small black spots | Low temp + low humidity-Memory effects | Interference fringes | Peak ratio Si(2p)/Ce(3d) | Ionic Impurities |
|---|---|---|---|---|---|
| Comparative D1 | xx | ○ | – | 0.03 | <1 ppm |
| Embodiment D1 | ○ | ○ | – | 0.25 | <1 ppm |
| Embodiment D2 | ○ | ○ | – | 0.48 | <1 ppm |
| Comparative D2 | ○ | x | – | 0.64 | <1 ppm |
| Comparative D3 | x | ○ | – | 0.03 | <1 ppm |
| Embodiment D3 | ○ | ○ | – | 0.25 | <1 ppm |
| Embodiment D4 | ○ | ○ | – | 0.48 | <1 ppm |
| Comparative D4 | ○ | xx | – | 0.64 | <1 ppm |
| Comparative D5 | x | ○ | – | 0.03 | <1 ppm |
| Embodiment D5 | ○ | ○ | – | 0.25 | <1 ppm |
| Embodiment D6 | ○ | ○ | – | 0.48 | <1 ppm |
| Comparative D6 | ○ | xx | – | 0.64 | <1 ppm |
| Comparative D7 | x | ○ | – | 0.03 | <1 ppm |
| Embodiment D7 | ○ | ○ | – | 0.25 | <1 ppm |
| Embodiment D8 | ○ | ○ | – | 0.48 | <1 ppm |
| Comparative D8 | ○ | x | – | 0.64 | <1 ppm |
| Comparative D9 | x | ○ | – | 0.03 | <1 ppm |
| Embodiment D9 | ○ | ○ | – | 0.25 | <1 ppm |
| Embodiment D10 | ○ | ○ | – | 0.48 | <1 ppm |
| Comparative D10 | ○ | x | – | 0.64 | <1 ppm |
| Comparative D11 | x | ○ | – | 0.03 | <1 ppm |
| Embodiment D11 | ○ | ○ | – | 0.25 | <1 ppm |
| Embodiment D12 | ○ | ○ | – | 0.48 | <1 ppm |
| Comparative D12 | ○ | x | – | 0.64 | <1 ppm |
| Comparative D13 | xx | ○ | – | 0.26 | 2 ppm $Na^+$ |
| Embodiment D13 | ○ | ○ | – | 0.25 | <1 ppm |

According to the present invention, an organosilicon coupling agent is bonded to the surfaces of small particles of titanium oxide, zirconium oxide, aluminum oxide or cerium oxide. The organosilicon coupling agent exhibits an Existence Ratio, represented by the peak intensity ratio (Si2p/Me2p, Me=Ti, Zr or Al) or (Si2p/Ce3d), of from 0.15 to 0.6 on a bonding energy spectrum measured by XPS. The surface treatment of the invention improves the dispersion of the metal oxide small particles in the polyamide copolymer resin for the undercoating layer. The ionic impurity concentration in the undercoating layer is below 1 ppm. Electrophotographic photoconductors having the undercoating layer of the present invention produce no small black spots in image tests in a hot and humid environment, and no small voids in a cold and dry environment. By dispersing metal oxide small particles of from about 200 to about 600 nm particle diameter into the undercoating layer, interference fringes are prevented.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor, comprising:

a conductive substrate;

an undercoating layer on said conductive substrate, said undercoating layer comprising binder resin;

a photoconductive layer on said undercoating layer;

particles of cerium oxide, said particles being dispersed in said binder resin;

a coupling agent;

said coupling agent being an aminosilane compound;

said coupling agent being bonded to said particles' surfaces at an Existence Ratio expressed as a peak intensity ratio of bonding energy spectra produced by X-ray photoelectron spectroscopic analysis;

said peak intensity ratio being a peak intensity ratio of the 2p electron of silicon atom to the 3d electron of said cerium oxide;

said peak intensity ratio being from 0.15 to 0.6; and said undercoating layer containing not more than 1 ppm of ionic impurities.

2. The photoconductor according to claim 1, wherein said aminosilane compound is γ-aminopropyltriethoxysilane.

3. The photoconductor according to claim 1, wherein said ionic impurities include at least one ion selected from the group consisting of sodium ion, potassium ion, calcium ion, chlorine ion, sulfate ion, sulfite ion, and phosphate ion.

4. The photoconductor according to claim 1, wherein said binder resin is a polyamide resin.

5. The photoconductor according to claim 4, wherein said polyamide resin is copolymerized polyamide which includes a monomeric unit bound to a polyamide molecule through an ether linkage.

6. The photoconductor according to claim 4, wherein said polyamide resin is a copolymerized polyamide, and said polyamide is selected from the group consisting of a cycloaliphatic polyamide and a heterocyclic polyamide.

7. The photoconductor according to claim 1, wherein said particles of cerium oxide include at least 30 weight % of particles having a particle diameter of about 200 to about 600 nm.

8. A method of manufacturing an electrophotographic photoconductor including a conductive substrate; an undercoating layer on said conductive substrate, said undercoating layer comprising binder resin; a photoconductive layer on said undercoating layer; particles of at least one metal oxide selected from the group consisting of titanium oxide, zirconium oxide, aluminum oxide and cerium oxide, said particles being dispersed in said binder resin; a coupling agent of an organosilicon compound, said coupling agent being bonded to said particles' surfaces at an X-ray photoelectron spectroscopic Existence Ratio of from 0.15 to 0.6; said Existence Ratio being expressed as a peak intensity ratio of bonding energy spectra produced by X-ray photoelectron spectroscopic analysis; said peak intensity ratio being a ratio of a peak intensity of a 2p electron of silicon atom to a peak intensity of a 2p electron of said titanium oxide, zirconium oxide, or aluminum oxide, or, alternatively, in the case of cerium oxide, said peak intensity ratio being ratio of a peak intensity of a 2p electron of silicon atom to a peak intensity of a 3d electron of cerium oxide; and not more than 1 ppm of ionic impurities contained in said undercoating layer, comprising steps of:

preparing a first mixture of said at least one metal oxide particles and said organosilicon coupling agent;

applying vapor phase surface treatment to said first mixture, whereby said organosilicon coupling agent is mechanochemically bonded to said surfaces of said particles;

preparing a second mixture by mixing said first mixture with a binder resin;

applying said second mixture to a conductive substrate to form an undercoating layer; and forming a photoconductive layer on said undercoating layer, whereby an electrophotographic photoconductor is formed.

9. The method according to claim 8, wherein said organosilicon compound is an aminosilane compound.

* * * * *